US010399729B2

(12) United States Patent
Peng

(10) Patent No.: US 10,399,729 B2
(45) Date of Patent: Sep. 3, 2019

(54) ROLLABLE HEAT PRESERVATION

(71) Applicant: Pandian Peng, Shenzhen (CN)

(72) Inventor: Pandian Peng, Shenzhen (CN)

( * ) Notice: Subject to any disclaimer, the term of this patent is extended or adjusted under 35 U.S.C. 154(b) by 49 days.

(21) Appl. No.: 15/462,835

(22) Filed: Mar. 18, 2017

(65) Prior Publication Data

US 2017/0267393 A1 Sep. 21, 2017

(30) Foreign Application Priority Data

Mar. 18, 2016 (CN) ..... 2016 2 0208523 U

(51) Int. Cl.

| | |
|---|---|
| ***B65D 1/02*** | (2006.01) |
| ***B65D 43/02*** | (2006.01) |
| ***B65D 81/38*** | (2006.01) |
| ***A45F 3/20*** | (2006.01) |

(52) U.S. Cl.

CPC ..... *B65D 1/0292* (2013.01); *A45F 3/20* (2013.01); *B65D 1/023* (2013.01); *B65D 43/02* (2013.01); *B65D 81/3874* (2013.01)

(58) Field of Classification Search

CPC . A45F 3/20; A45F 2003/166; B65D 81/3869; B65D 53/02; B65D 1/023; B65D 43/02; B65D 81/3874; B65D 81/3876; B65D 81/3881; B65D 1/0292

See application file for complete search history.

(56) References Cited

U.S. PATENT DOCUMENTS

| | | | | |
|---|---|---|---|---|
| 5,226,551 | A * | 7/1993 | Robbins, III | B65D 1/0292 220/8 |
| 5,562,221 | A * | 10/1996 | Beniacar | B65D 1/0292 215/386 |
| D806,476 | S * | 1/2018 | Karl, IV | D7/509 |
| 2006/0255048 | A1* | 11/2006 | Bemis | A45F 3/20 220/703 |
| 2011/0204069 | A1* | 8/2011 | Moon | B65D 81/3869 220/660 |
| 2013/0075343 | A1* | 3/2013 | Hawks | C02F 1/66 210/747.2 |
| 2014/0263368 | A1* | 9/2014 | Booska | B65D 81/3484 220/592.17 |
| 2014/0353347 | A1* | 12/2014 | Fischer | A45C 13/10 224/148.4 |
| 2016/0347503 | A1* | 12/2016 | Tsui | B65D 1/0292 |

* cited by examiner

*Primary Examiner* — Shawn M Braden

(57) ABSTRACT

A rollable heat preservation cup, comprising a cup cover, a fixing ring, a bottleneck, and a two-layered cup body which further comprises an inner-layer cup body and an outer-layer cup body, wherein the two-layered cup body is a rollable and soft cup body, wherein a heat-preserving material layer is disposed between the inner-layer cup body and the outer-layer cup body, wherein a fixing ring is disposed between the bottleneck and the cup body, wherein the upper end part of the two-layered cup body is firmly embedded into an inner space formed by the fixing ring and the bottleneck.

9 Claims, 5 Drawing Sheets

ROLLABLE HEAT PRESERVATION

TECHNICAL FIELD OF THE INVENTION

The present invention relates to the technical field of daily-used cups, and more particularly, to a rollable heat preservation cup having a good portability and heat preserving effect, which can be conveniently used outdoors.

BACKGROUND OF THE INVENTION

With the improvement of living standards, people have grown to enjoy travel and outdoor exercise. In order to satisfy the using requirement of containing more water, the cup body is usually designed to be large-sized. However, the cups containing a lot of water can occupy more space—even empty cups. Thus, the inconvenience of carrying a large-sized water cup results in a bad experience of the users. In the prior art, some rollable water cups sold in the market are made of soft material, allowing the users to roll up the cup bodies so as to reduce the volume. Although the traditional rollable water cups can satisfy a broad range of using requirements, they also have some shortcomings, such as the difficulty of preserving heat.

As the market grows, the users demand for higher performance of the rollable water cups, triggering a sharp competition of the market. To win the market and lead the sales, the design of the rollable water cup is required to be innovative no matter in structure, function or appearance, pushing the enterprises in this field to conceive and develop a multi-functional product which can satisfy the various requirements of the users, In conclusion, the shortcomings of the traditional rollable water cups are urgent problems that need to be solved for those skilled in this field.

SUMMARY OF THE INVENTION

The purpose of the present invention is to solve the shortcomings in the prior art and provide a rollable heat preservation cup having a good portability and heat preserving effect, which can be conveniently used outdoors.

To achieve the above purpose, the present invention adopts the following technical solution:

A rollable heat preservation cup comprises a cup cover, a fixing ring, a bottleneck and a two-layered cup body which further comprises an inner-layer cup body and an outer-layer cup body. The two-layered cup body is a rollable and soft cup body. A heat-preserving material layer is disposed between the inner-layer cup body and the outer-layer cup body. A fixing ring is disposed between the bottleneck and the cup body. The upper end part of the two-layered cup body is firmly embedded into an inner space formed by the fixing ring and the bottleneck.

In another preferred embodiment, the upper end part of the cup body is a C-shaped bending part. The upper end part of the inner-layer cup body extends upward to form a protruding portion, and the lower end of the bottleneck, which is near the protruding portion, extends downward to form a convex portion, wherein the convex portion is disposed against the backside of the protruding portion. The upper end part of the outer-layer cup body extends downward to form a protruding portion too, and the inner side of the fixing ring extends upward to form a convex portion, wherein the convex portion is disposed against the backside of the protruding portion. The two protruding portions closely contact the corresponding convex portions, enabling the cup body to be effectively limited and fixed.

In another preferred embodiment, the lower end of the bottleneck extends downward to form an extending portion. The extending portion closely contacts the inner wall of the inner-layer cup body, which can further fix the cup body.

In another preferred embodiment, the upper end part of the outer-layer cup body extends upward to form a protruding portion, namely, a T-shaped end part. An accommodating groove is disposed between the extending portion and the convex portion of the bottleneck. When the cup body is compressed by the convex portion, the deformed portion of the cup body can be accommodated in the accommodating groove.

In another preferred embodiment, the convex portion which is formed by the downward extension of the lower end of the bottleneck is contacted to the cup body, at where they are contacted is disposed an adhesive layer.

In another preferred embodiment, the cup body is made of silicon gel, and the thickness of the inner-layer cup body is greater than that of the outer-layer cup body.

In another preferred embodiment, the hardness of the upper end part of the cup body is greater than that of the remaining parts of the cup body.

In another preferred embodiment, the cup cover, the fixing ring and the bottleneck are made of hard material.

In another preferred embodiment, the cup cover and the bottleneck are in threaded connection. A sealing ring is disposed at the inner side of the cup cover. When the cup cover rotates to connect the bottleneck, the sealing ring located between the cup cover and the upper end of the bottleneck can be compressed to achieve an ideal sealing effect.

Compared with the prior art, the present invention provides a rollable heat preservation cup having a multi-layered cup body, in which is disposed a heat-preserving material layer. In practical use, the speed of heat transmission of the multi-layered cup body is far lower than that of the single-layered cup body. The multi-layered cup body not only can achieve an ideal heat-preserving effect, but also can avoid the water leakage caused by the damage of the cup body, which can greatly improve the life-span of the product. Furthermore, the upper end part of the cup body can be firmly fixed through the cooperation between the fixing ring and the bottleneck, which is so stable that the cup body cannot be pulled out from where it is embedded even by a great force, bringing a stable and reliable experience to the users.

BRIEF DESCRIPTION OF THE DRAWINGS

To clearly expound the present invention or technical solution, the drawings and embodiments are hereinafter combined to illustrate the present invention. Obviously, the drawings are merely some embodiments of the present invention and those skilled in the art can associate themselves with other drawings without paying creative labor.

DETAILED DESCRIPTION OF THE INVENTION

Drawings and detailed embodiments are combined hereinafter to elaborate the technical principles of the present invention.

Figure 1:
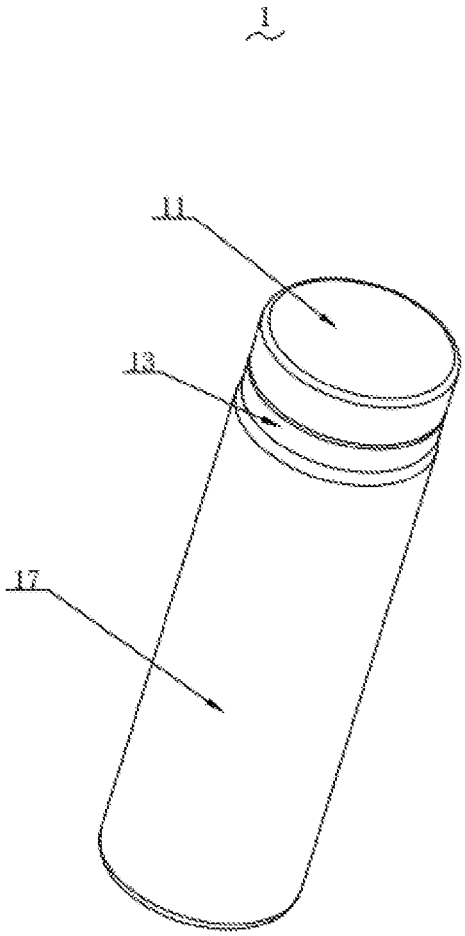
FIG. 1 is a three-dimensional diagram of the rollable heat preservation cup of the present invention.
Figure 2:
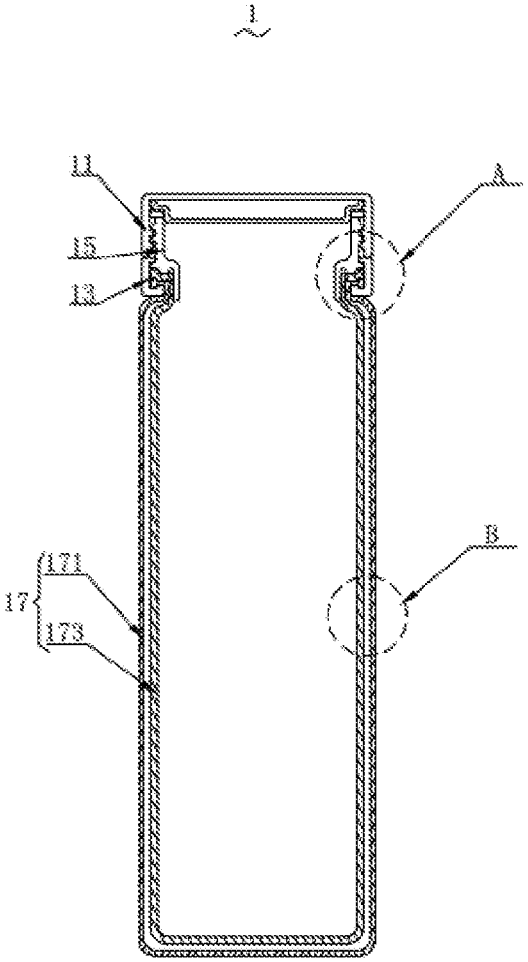
FIG. 2 is a sectional view of the rollable heat preservation cup of the present invention.
Figure 3:
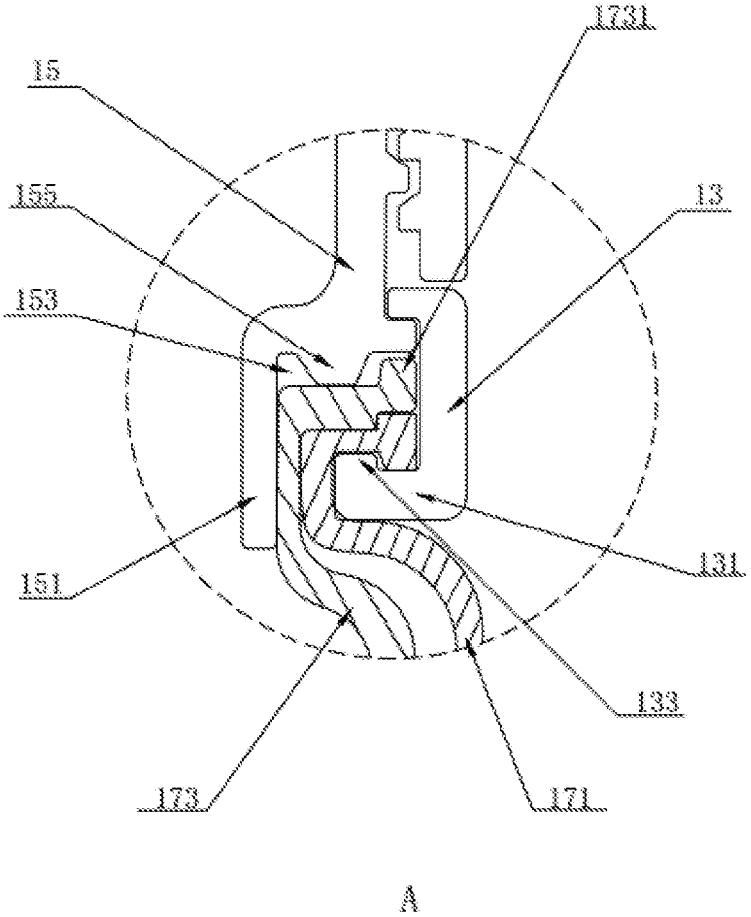
FIG. 3 is an enlarged schematic diagram of part A in diagram 2.
Figure 4:
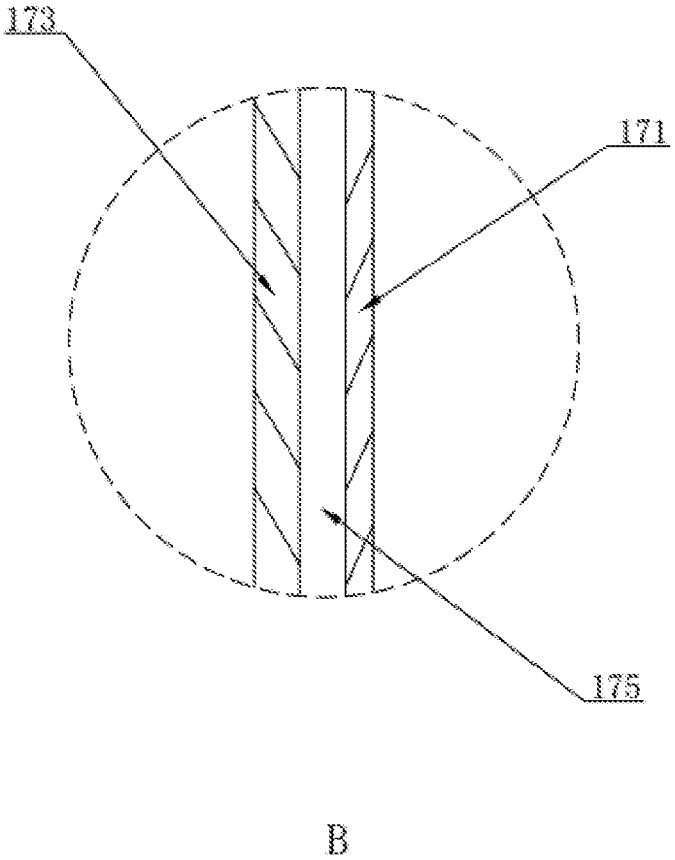
FIG. 4 is an enlarged schematic diagram of part B in diagram 2.
Figure 5:
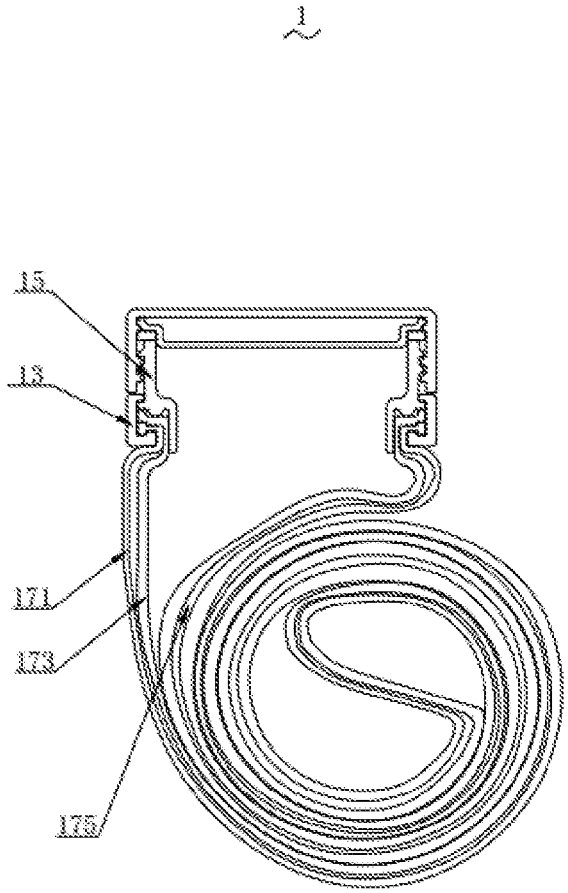
FIG. 5 is a structure diagram of the rolled heat preservation cup of the present invention.

As shown in FIGS. 1-5, the rollable heat preservation cup 1 of the present invention comprises a cup cover 11, a fixing ring 13, a bottleneck 15 and a two-layered cup body 17 which further comprises an inner-layer cup body 173 and an outer-layer cup body 171. The two-layered cup body 17 is a rollable and soft cup body 17. A heat-preserving material layer 175 is disposed between the inner-layer cup body 173 and the outer-layer cup body 171. A fixing ring 13 is disposed between the bottleneck 15 and the cup body 17. The upper end part of the two-layered cup body 17 is firmly embedded into an inner space formed by the fixing ring 13 and the bottleneck 15. The present invention provides a rollable heat preservation cup having a multi-layered cup body 17, in which is disposed a heat-preserving material layer 175. In practical use, the speed of heat transmission of the multi-layered cup body 17 is far lower than that of a single-layered cup body 17. The design of the multi-layered cup body 17 not only can achieve an ideal heat-preserving effect, but also can avoid the water leakage caused by the damage of the cup body 17, which greatly improves the life-span of the product. Furthermore, the upper end part of the cup body 17 can be firmly fixed through the cooperation between the fixing ring 13 and the bottleneck 15, which is so stable that the cup body 17 cannot be pulled out from where it is embedded even by a great force, bringing an excellent experience to the users.

The upper end part of the cup body 17 is a C-shaped bending part. The upper end part of the inner-layer cup body 173 extends upward to form a protruding portion 1731, and the lower end of the bottleneck 15, which is near the protruding portion 1731, extends downward to form a convex portion 155. The convex portion 155 is disposed against the backside of the protruding portion 1731. Meanwhile, the upper end part of the outer-layer cup body 171 also extends downward to form a protruding portion 1731, and the inner side of the fixing ring 13 extends upward to form a convex portion 133. The convex portion 133 is disposed against the backside of the protruding portion 1731. The two protruding portions 1731 closely contact the corresponding convex portions 133(155), enabling the cup body 17 to be effectively limited and fixed. From the perspective of forced direction, when the cup body 11 is pulled, the upper end part of the cup body 17 can be horizontally forced under the action of the external force. Furthermore, the force imposed on the upper end part of the cup body 17 in horizontal direction is the maximum. Meanwhile, the convex portion 155 is exactly disposed against the backside of the protruding portion 1731. According to the cooperating mode between the protruding portion 1731 and the convex portion 155, the main forced direction of the protruding portion 1731 can be limited, and the movement of the cup body 17 can be impeded, which achieves a better stability of the cup structure.

The lower end of the bottleneck 15 extends downward to form an extending portion 151. The extending portion 151 closely contacts the inner wall of the inner-layer cup body 173, which can further fix the cup body 173. The extending portion 151 extends until the bottom of the C-shaped bending part of the inner-layer cup body 173. According to this limiting mechanism, the freedom degree of the C-shaped bending part can be 1. Namely, the C-shaped bending part can merely move downward, and the movement to any other directions can be limited. Meanwhile, the vertically-downward movement of the C-shaped bending part, namely, the extension of the cup body 17, can be limited by the protruding portion and the convex portion at the upper end part of the cup body 17, enabling the cup structure to be more stable and reliable.

The upper end part of the outer-layer cup body 171 extends upward to form a protruding portion, namely, a T-shaped end part. An accommodating groove 153 is disposed between the extending portion 151 and the convex portion 155 of the bottleneck 15. When compressed by the convex portion 155, the cup body 17 can be deformed due to the compression, and the deformed portion of the cup body 17 can be accommodated in the accommodating groove 153. Compared with an independent protruding portion, the T-shaped protruding portion has a better stability. According to this design, each layer of the cup body 17 is interacted with the other layers. Namely, one layer of the cup body 17 is chained to another layer of the cup body 17 so that all of them can be chained together. The accommodating groove 153 can accommodate the deformed portion of the cup body 17. Consequently, when the cup body 17 is pulled by an external force, the position of the upper end part of the cup body 17 which is embedded into the inner space formed by the fixing ring 13 and the bottleneck 15 can keep unchanged, avoiding the cup body 17 from moving outward due to the lack of accommodation. According to above design, the material can be effectively saved and the stability of the cup body 17 can be greatly enhanced.

The convex portion 155 which is formed by the downward extension of the lower end of the bottleneck 15 is contacted to the cup body 17, at where they are contacted is disposed an adhesive layer. The adhesive layer is used to better fix the cup body 17, which can make the relative movement between the upper end part of the cup body 17 and the convex portion 155 to be difficult. Consequently, the overall stability of the cup body 17 can be further ensured, achieving an ideal using effect.

The cup body 17 is made of silicon gel, and the thickness of the inner-layer cup body 173 is greater than that of the outer-layer cup body 171. In practice, when the cup body 17 is rolled, the reducibility of the inner-layer cup body 173 can become stronger, which can assist the recovery of the outer-layer cup body 171 during the recovering process of the whole cup body 17. Thus, the recovering efficiency of the cup body 17 can be greatly improved, bringing the users a quick experience.

Furthermore, the hardness of the upper end part of the cup body 17 is greater than that of the remaining parts of the cup body 17. The upper end part of the cup body 17 is firmly embedded into the inner space formed by the fixing ring 13 and the bottleneck 15 so that the whole cup body 17 can be fixed. However, this structure may lead to a poor stability if the hardness of the upper end part of the cup body 17 is not enough. Even worse, the upper end part of the cup body 17 may easily drop from where it is embedded, resulting a bad using experience. To solve this problem, the hardness of the upper end part is designed to be greater than that of the remaining parts.

In another preferred embodiment, the cup cover 11, the fixing ring 13 and the bottleneck 15 are made of hard material, which can sufficiently meet the hardness requirement of fixing the upper end part of the cup body 17.

The cup cover 11 and the bottleneck 15 are in threaded connection. A sealing ring is disposed at the inner side of the cup cover 11. When the cup cover 11 rotates to connect the bottleneck 15, the sealing ring located between the cup cover 11 and the upper end of the bottleneck 15 can be compressed to achieve an ideal sealing effect. According to the reasonable design of the sealing ring, the leakage-proof performance of the cup body 17 can be greatly enhanced.

Compared with the prior art, the present invention provides a rollable heat preservation cup 1 having a multi-layered cup body 17, in which is disposed a heat-preserving material layer 175. In practical use, the speed of heat transmission of the multi-layered cup body 17 is far lower than that of the single-layered cup body 17. The multi-layered cup body 17 not only can achieve an ideal heat-preserving effect, but also can avoid the water leakage caused by the damage of the cup body 17, which can greatly improve the life-span of the product. Furthermore, the upper end part of the cup body 17 is firmly fixed through the cooperation between the fixing ring 13 and the bottleneck 15, which is so stable that the cup body 17 cannot be pulled out from where it is embedded even by a great force, bringing a stable and reliable experience to the users.

The previous descriptions are of preferred examples for implementing the invention, and the scope of the invention should not necessarily be limited by this description. The scope of the present invention is defined by the claims.

The invention claimed is:

1. A rollable heat preservation cup, comprising:

a cup cover, a fixing ring, a bottleneck, and a two-layered cup body which further comprises an inner-layer cup body and an outer-layer cup body, wherein the two-layered cup body is a rollable and soft cup body, wherein a heat-preserving material layer is disposed between the inner-layer cup body and the outer-layer cup body, wherein a fixing ring is disposed between the bottleneck and the cup body, wherein an upper end part of the two-layered cup body is firmly embedded into an inner space formed by the fixing ring and the bottleneck.

2. The rollable heat preservation cup of claim 1, wherein the upper end part of the inner-layer cup body extends upward to form a protruding portion, and the lower end of the bottleneck, which is near the protruding portion, extends downward to form a convex portion, wherein the convex portion is disposed against a backside of the protruding portion, wherein an upper end part of the outer-layer cup body extends downward to form a protruding portion, and an inner side of the fixing ring extends upward to form a convex portion, wherein the convex portion is disposed against a backside of the protruding portion, wherein the two protruding portions closely contact the corresponding convex portions.

3. The rollable heat preservation cup of claim 2, wherein the lower end of the bottleneck extends downward to form an extending portion, wherein the extending portion closely contacts an inner wall of the inner-layer cup body, which can further fix the cup body.

4. The rollable heat preservation cup of claim 2, wherein the upper end part of the outer-layer cup body extends upward to form a protruding portion, namely, a T-shaped end part, wherein an accommodating groove is disposed between the extending portion and the convex portion of the bottleneck, wherein when the cup body is compressed by the convex portion, the deformed portion of the cup body can be accommodated in the accommodating groove.

5. The rollable heat preservation cup of claim 4, wherein the convex portion which is formed by the downward extension of the lower end of the bottleneck is contacted to the cup body, at where they are contacted is disposed an adhesive layer.

6. The rollable heat preservation cup of claim 1, wherein the cup body is made of silicon gel, wherein the thickness of the inner-layer cup body is greater than that of the outer-layer cup body.

7. The rollable heat preservation cup of claim 6, wherein the hardness of the upper end part of the cup body is greater than that of remaining parts of the cup body.

8. The rollable heat preservation cup of claim 1, wherein the cup cover, the fixing ring and the bottleneck are made of hard material.

9. The rollable heat preservation cup of claim 1, wherein the cup cover and the bottleneck are in threaded connection, wherein a sealing ring is disposed at the inner side of the cup cover, wherein when the cup cover rotates to connect the bottleneck, the sealing ring located between the cup cover and the upper end of the bottleneck can be compressed to achieve a sealing effect.

* * * * *